US007875580B2

(12) United States Patent
Oldfield

(10) Patent No.: US 7,875,580 B2
(45) Date of Patent: Jan. 25, 2011

(54) ANTIWEAR AUTOMOTIVE FORMULATIONS

(75) Inventor: Andrew S Oldfield, Northants (GB)

(73) Assignee: Croda Internatonal PLC, Goole, East Yorkshire (GB)

( * ) Notice: Subject to any disclaimer, the term of this patent is extended or adjusted under 35 U.S.C. 154(b) by 243 days.

(21) Appl. No.: 10/591,690

(22) PCT Filed: Feb. 25, 2005

(86) PCT No.: PCT/GB2005/000700

§ 371 (c)(1),
(2), (4) Date: Jun. 18, 2007

(87) PCT Pub. No.: WO2005/085401

PCT Pub. Date: Sep. 15, 2005

(65) Prior Publication Data

US 2007/0254818 A1 Nov. 1, 2007

(30) Foreign Application Priority Data

Mar. 1, 2004 (GB) ..... 0404535.7

(51) Int. Cl.
*C10M 129/78* (2006.01)
*C10M 129/80* (2006.01)

(52) U.S. Cl. ..... 508/492; 508/455; 508/485

(58) Field of Classification Search ..... 508/384, 508/577, 455, 492, 485, 493, 495
See application file for complete search history.

(56) References Cited

U.S. PATENT DOCUMENTS

| | | | | |
|---|---|---|---|---|
| 3,202,701 | A * | 8/1965 | Pare et al. | 560/199 |
| 3,390,083 | A | 6/1968 | Lion | |
| 3,717,672 | A * | 2/1973 | McGee | 560/191 |
| 4,293,432 | A * | 10/1981 | Papay et al. | 508/438 |
| 4,459,223 | A * | 7/1984 | Shaub et al. | 508/476 |
| 4,479,883 | A | 10/1984 | Shaub | |
| 4,783,274 | A * | 11/1988 | Jokinen et al. | 508/209 |
| 5,750,477 | A * | 5/1998 | Sumiejski et al. | 508/331 |
| 6,462,001 | B1 * | 10/2002 | Kenbeek et al. | 508/492 |

FOREIGN PATENT DOCUMENTS

| | | |
|---|---|---|
| EP | 0 335 013 | 10/1989 |
| GB | 1 390 439 | 4/1975 |

OTHER PUBLICATIONS

Cropa Product Overiew.*

* cited by examiner

*Primary Examiner*—Ellen M McAvoy
*Assistant Examiner*—Pamela Weiss
(74) *Attorney, Agent, or Firm*—Jones Day

(57) ABSTRACT

An automotive engine oil comprising a base oil and an antiwear additive system comprising an ester. The antiwear additive system preferably further comprises a phosphorus-containing and/or sulphur-containing antiwear additive. The antiwear additive system of the invention has superior antiwear properties and also reduced metal, phosphorus and sulphur levels compared to current commercial antiwear agents such as ZDDP.

13 Claims, 1 Drawing Sheet

ANTIWEAR AUTOMOTIVE FORMULATIONS

CROSS REFERENCE TO RELATED APPLICATION

This application is the National Phase application of International Application No. PCT/GB2005/000700, filed Feb. 25, 2005, which designates the United States and was published in English. This application, in its entirety, is incorporated herein by reference.

The present invention relates to automotive engine oils comprising a base oil and an antiwear additive system comprising an ester and preferably further comprising a phosphorus-containing and/or sulphur-containing antiwear additive and the use of automotive engine oils comprising the antiwear additive system.

The automotive industry is under pressure to meet higher engine oil performance requirements whilst at the same time lowering emissions. The International Lubricant Standardisation and Approval Committee (ILSAC) GF-4 requirements for automotive engine oil have just been published. One key area where the specification has been tightened is the level of phosphorus. This is because phosphorus has been identified as a catalyst poison for the catalysts that are used in emission control systems. The allowed phosphorus level will now be a maximum of 0.08% by weight in the automotive engine oil, which is a 20% reduction from the level set in the GF-3 requirements. However ILSAC's original aim was a maximum allowed phosphorus level of 0.05%, which is indicative of future legislation reducing the proposed 0.08% level further.

It is expected that focus will now move to other elements in the engine oil, as well as phosphorus, that could impact emission control systems. For example sulphur is known to poison deNOx catalysts and ash residues from metals are known to plug after-treatment particulate traps.

Antiwear protection in modern automotive engine oils is mainly provided by the additive zinc dialkyl dithiophosphate (ZDDP), which contains phosphorus, sulphur and zinc. It is believed that the ZDDP degrades at potential wear points in the engine to form a polyphosphate glassy film which protects the potential wear points. The ZDDP is typically supplied as a concentrated solution (typically 80-100% ZDDP) in mineral oil. At current use levels (typically 0.5-1.5% of ZDDP solution) it is believed that ZDDP accounts for more than two thirds of the sulphur and all of the zinc and phosphorus present in engine oils. It is clear that this additive has a major effect on the emission control systems and as such the use of alternative antiwear additives needs to be explored.

The engine test requirements of the ILSAC GF-4 specification include the Sequence IVA test. This test is designed to evaluate an oil's ability in preventing camshaft lobe wear in slider valve train design engines operated at low-temperature, short-trip, "stop-and-go" conditions. One of the key pass/fail criteria of the test is that the average cam wear cannot be greater than 90 μm. Therefore any alternatives to ZDDP must at least meet the Sequence IVA pass/fail criteria whilst also providing a reduction in metal, phosphorus and/or sulphur levels.

ZDDP is also known to function as an oxidation inhibitor when used as an additive is an automotive engine oil. Therefore any alternatives to ZDDP must also exhibit oxidation inhibition properties.

Investigations undertaken by the inventors have led to the identification of an ester which is suitable to be used in an antiwear additive system, either by itself or to be used in conjunction with a reduced level of a phosphorus and/or sulphur containing antiwear additive in automotive engine oils. The antiwear additive system of the invention not only has reduced metal, phosphorus and sulphur levels but surprisingly also can provide antiwear properties that are superior to those of commercial antiwear additives in automotive engine oils. Furthermore the antiwear additive system of the invention exhibits oxidation inhibition properties.

According to the present invention, an automotive engine oil comprising a base oil and an antiwear additive system comprising an ester which is the reaction product of (a) at least one polyfunctional alcohol;

(b) a dimer fatty acid; and (c) optionally at least one of an aliphatic dicarboxylic acid having 5 to 18 carbon atoms, an aliphatic monocarboxylic acid having 5 to 24 carbon atoms and an aliphatic monofunctional alcohol having 5 to 24 carbon atoms with the resultant ester having a kinematic viscosity at 100° C. ranging from 500 to 5000 $mm^2/s$ and a non-polarity index (NPI)

$$NPI = \frac{\text{total number of carbon atoms} * \text{molecul. weight}}{\text{number of carboxylate groups} \times 100}$$

of at least 500.

Preferably c) is an essential feature of the automotive engine oil.

The Automotive Engine Oil

The term automotive engine oil includes both gasoline and diesel (including heavy duty diesel) engine oils.

The Base Oil

The base oil of the automotive engine oil may be chosen from any of the Group I to Group VI base oils as defined by the American Petroleum Institute (API). The base oil may be a mixture of Group I to Group VI base oils.

At Least One Polyfunctional Alcohol

The at least one polyfunctional alcohol is preferably a polyol. The polyol preferably is of formula R(OH)n where n is an integer, which ranges from 1-10 and R is a hydrocarbon chain, either branched or linear, more preferably branched, of 2 to 15 carbon atoms. The polyol is suitably of low molecular weight, preferably in the range from 50 to 650, more preferably 60 to 150, and particularly 60 to 100. Examples of suitable polyols include ethylene glycol, propylene glycol, trimethylene glycol, diols of butane, neopentyl glycol, trimethyol propane and its dimer, pentaerythritol and its dimer, glycerol, inositol and sorbitol. Preferably the polyol is a neopentyl polyol. Preferred examples of neopentyl polyols are neopentyl glycol, trimethylol propane and pentaerythritol. Preferably the neopentyl polyol comprises at least 50% by weight of neopentyl glycol, more preferably at least 70%, even more preferably at least 90%.

Dimer Fatty Acid

The term dimer fatty acid is well known in the art and refers to the dimerisation product of mono- or polyunsaturated fatty acids and/or esters thereof. Preferred dimer fatty acids are dimers of C10 to C30, more preferably C12 to C24, particularly C14 to C22, and especially C18 alkyl chains. Suitable dimer fatty acids include the dimerisation products of oleic acid, linoleic acid, linolenic acid, palmitoleic acid, and elaidic acid with oleic acid being particularly preferred. The dimerisation products of the unsaturated fatty acid mixtures obtained in the hydrolysis of natural fats and oils, e.g. sunflower oil, soybean oil, olive oil, rapeseed oil, cottonseed oil and tall oil, may also be used. Hydrogenated, for example by using a nickel catalyst, dimer fatty acids may also be employed.

In addition to the dimer fatty acids, dimerisation usually results in varying amounts of oligomeric fatty acids (so-called "trimer") and residues of monomeric fatty acids (so-called "monomer"), or esters thereof, being present. The amount of monomer can, for example, be reduced by distillation. Particularly preferred dimer fatty acids used in the present invention, have a dimer content of greater than 50%, more preferably greater than 70%, particularly greater than 85%, and especially greater than 94% by weight.

The trimer content is preferably less than 50%, more preferably in the range from 1 to 20%, particularly 2 to 10%, and especially 3 to 6% by weight. The monomer content is preferably less than 5%, more preferably in the range from 0.1 to 3%, particularly 0.3 to 2%, and especially 0.5 to 1% by weight.

Optionally at Least One of an Aliphatic Dicarboxylic Acid, an Aliphatic Monocarboxylic Acid, and an Aliphatic Monofunctional Alcohol.

Examples of suitable aliphatic dicarboxylic acids include glutaric, adipic, pimelic, suberic, azelaic, sebacic, undecanedioic, dodecanedioic, tridecanedioic, tetradecanedioic, pentadecanedioic, hexadecanedioic acids and mixtures thereof. The aliphatic dicarboxylic acid preferably has from 7 to 16 carbon atoms, more preferably from 8 to 14 carbon atoms. The aliphatic dicarboxylic acid is preferably linear. Azelaic acid, sebacic acid and dodecanedioic acid are particularly preferred. Azelaic acid is especially preferred.

The monoacid or monoalcohol, may be used to react with any OH or COOH groups respectively which remain unreacted after reaction between the polyfunctional alcohol and the dimer fatty acid and optionally the aliphatic dicarboxylic acid. Examples of the at least one aliphatic monocarboxylic acid include the saturated straight chained acids of pentanoic, hexanoic, heptanoic, octanoic, nonanoic, decanoic, undecanoic, dodecanoic, tridecanoic, tetradecanoic, pentadecanoic, hexadecanoic, heptadecanoic, octadecanoic, arachidic, behenic and lignoceric acids and mixtures thereof. Examples also include unsaturated and/or branched variants of the disclosed saturated, straight-chained acids. The at least one aliphatic monocarboxylic acid preferably has 7 to 20 carbon atoms, more preferably 8 to 18 carbon atoms. It may be branched or straight chained and preferably is saturated. Particularly preferred monoacids are a mixture of octanoic and decanoic acids, and isostearic acid.

Examples of the aliphatic monofunctional alcohol include pentanol, hexanol, heptanol, octanol, nonanol, decanol, undecanol, dodecanol, tridecanol, tetradecanol, pentadecanol, hexadecanol, heptadecanol, octadecanol and mixtures thereof. Examples also include unsaturated and/or branched variants of the disclosed saturated, straight chained acids The aliphatic monofunctional alcohol preferably has 7 to 16 carbon atoms, more preferably 8 to 14 carbon atoms. It may be branched or straight chained and preferably is saturated. 2-Ethylhexanol is particularly preferred.

The resultant ester preferably has a kinematic viscosity at 100° C. of 900 to 4000, more preferably 1100 to 3500, especially 1500-2500 $mm^2/s$.

The resultant ester preferably has a NPI value of at least 900, more preferably at least 1200 and especially at least 1500.

The resultant ester preferably has an average molecular weight of at least 3000, more preferably at least 4000 and especially at least 5000.

Preferred resultant esters include an ester which is the reaction product of a polyol, preferably a neopentyl polyol, more preferably neopentylglycol with dimer acid and an ester which is the reaction product of a polyol, preferably a neopentyl polyol, more preferably neopentylglycol with dimer acid and a C5-C18 dicarboxylic acid, more preferably a C7-C16 dicarboxylic acid, particularly a C8-C14 dicarboxylic, especially azeleic acid.

The antiwear additive system preferably further comprises a phosphorus-containing and/or sulphur-containing antiwear additive.

The phosphorus-containing and/or sulphur-containing antiwear additive may also contain other inorganic elements such as nitrogen and halogens, in particular chlorine, boron and silicon. Furthermore it may contain metallic elements such as zinc, molybdenum, tungsten and niobium.

Examples of phosphorus-containing additives include phosphate esters, acid phosphates, phosphites and dialkyl alkyl phosphonates. Examples of sulphur-containing additives include sulphurized olefins, sulphurized esters, sulphurized aromatics, trithianes and derivatives of thioglycolates. Examples of phosphorus and sulphur-containing additives include dithiophosphates, thiophosphates and phosphorothionates. Preferred examples of a dithiophosphate are molybdenum dialkyl dithiophosphates and ZDDP with ZDDP being especially preferred. Examples of phosphorus and nitrogen-containing additives include phosphoramides and amine phosphates. Examples of sulphur and nitrogen-containing additives include dithiocarbamates, for example molybdenum dithiocarbamates (MoDTC), ammonium salts of sulphonic acid, amine salts of thiocyanic acid, alkyldithiobenzoxazoles, derivatives of 2-mercaptobenzothiazole and 2,5-dimercapto-1,3,4-thiadiazole. Examples of sulphur, phosphorus and nitrogen-containing additives include amine thiophosphates and amine dithiophosphates.

Preferably the phosphorus-containing and/or sulphur-containing antiwear additive contains both phosphorus and sulphur. More preferably the phosphorus-containing and/or sulphur-containing antiwear additive also contains zinc or molybdenum, particularly the phosphorus-containing and/or sulphur-containing antiwear additive is ZDDP.

When the ester and the phosphorus-containing and/or sulphur-containing antiwear additive are both present in the antiwear additive system the ratio of ester to phosphorus-containing and/or sulphur-containing antiwear additive ranges from 80:20 to 20:80 weight percent, preferably from 70:30 to 30:70 and particularly from 60:40 to 40:60.

The antiwear additive system according to the invention has no more than 10 wt % phosphorus, preferably no more than 7 wt %, more preferably no more than 6 wt % phosphorus.

The antiwear additive system according to the invention is present at levels between 0.1 and 5% by weight, more preferably between 0.3 and 4%, even more preferably between 0.5 and 3% in the automotive engine oil.

A specifically preferred antiwear additive system comprises 0.5% by weight in the automotive engine oil of an ester which is the reaction product of neopentylglycol with dimer acid with 0.5% by weight in the automotive engine oil of a ZDDP solution (for example Lubrizol L1371). A further specifically preferred antiwear additive system comprises 0.5% by weight in the automotive engine oil of an ester which is the reaction product of neopentylglycol with dimer acid and azeleic acid with 0.5% by weight in the automotive engine oil of a ZDDP solution (for example Lubrizol L1371).

The automotive engine oil comprising the base oil and antiwear additive system preferably has no more than 0.08 wt % phosphorus, more preferably no more than 0.07 wt %, especially no more than 0.06 wt % phosphorus present.

The automotive engine oil also comprises other types of additives of known functionality at levels between 0.1 to 30%, more preferably between 0.5 to 20% more especially between 1 to 10% of the total weight of the engine oil. These can include detergents, dispersants, oxidation inhibitors, corrosion inhibitors, rust inhibitors, friction modifiers, foam depressants, pour point depressants, viscosity index improvers and mixtures thereof. Viscosity index improvers include polyisobubutenes, polymethacrylate acid esters, polyacrylate acid esters, diene polymers, polyalkyl styrenes, alkenyl aryl conjugated diene copolymers and polyolefins. Foam depressants include silicones and organic polymers. Pour point depressants include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents include carboxylic dispersants, amine dispersants, Mannich dispersants and polymeric dispersants. Friction modifiers include amides, amines and partial fatty acid esters of polyhydric alcohols. Ash-containing dispersants include neutral and basic alkaline earth metal salts of an acidic organic compound. Oxidation inhibitors include hindered phenols and alkyl diphenylamines. Additives may include more than one functionality in a single additive.

According to a further embodiment of the present invention an antiwear additive system comprising an ester which is the reaction product of (a) at least one polyfunctional alcohol;

(b) a dimer fatty acid; and (c) optionally at least one of an aliphatic dicarboxylic acid having 5 to 18 carbon atoms, an aliphatic monocarboxylic acid having 5 to 24 carbon atoms and an aliphatic monofunctional alcohol having 5 to 24 carbon atoms with the resultant ester having a kinematic viscosity at 100° C. ranging from 500 to 5000 $mm^2/s$ and a non-polarity index (NPI)

$$NPI = \frac{\text{total number of carbon atoms} * \text{molecul weight}}{\text{number of carboxylate groups} \times 100}$$

of at least 500.

The antiwear additive system preferably further comprises a phosphorus-containing and/or sulphur-containing antiwear additive.

According to a further embodiment of the present invention a method of reducing wear in an automotive engine by the use of an automotive engine oil comprising a base oil and an antiwear additive system comprising an ester which is the reaction product of (a) at least one polyfunctional alcohol;

(b) a dimer fatty acid; and (c) optionally at least one of an aliphatic dicarboxylic acid having 5 to 18 carbon atoms, an aliphatic monocarboxylic acid having 5 to 24 carbon atoms and an aliphatic monofunctional alcohol having 5 to 24 carbon atoms with the resultant ester having a kinematic viscosity at 100° C. ranging from 500 to 5000 $mm^2/s$ and a non-polarity index (NPI)

$$NPI = \frac{\text{total number of carbon atoms} * \text{molecul weight}}{\text{number of carboxylate groups} \times 100}$$

of at least 500.

According to a further embodiment of the present invention use of an automotive engine oil comprising a base oil and an antiwear additive system comprising an ester which is the reaction product of (a) at least one polyfunctional alcohol;

(b) a dimer fatty acid; and (c) optionally at least one of an aliphatic dicarboxylic acid having 5 to 18 carbon atoms, an aliphatic monocarboxylic acid having 5 to 24 carbon atoms and an aliphatic monofunctional alcohol having 5 to 24 carbon atoms with the resultant ester having a kinematic viscosity at 100° C. ranging from 500 to 5000 $mm^2/s$ and a non-polarity index (NPI)

$$NPI = \frac{\text{total number of carbon atoms} * \text{molecul weight}}{\text{number of carboxylate groups} \times 100}$$

of at least 500 to reduce wear in an automotive engine.

According to a further embodiment of the present invention the use of an antiwear additive system comprising an ester which is the reaction product of (a) at least one polyfunctional alcohol;

(b) a dimer fatty acid; and (c) optionally at least one of an aliphatic dicarboxylic acid having 5 to 18 carbon atoms, an aliphatic monocarboxylic acid having 5 to 24 carbon atoms and an aliphatic monofunctional alcohol having 5 to 24 carbon atoms with the resultant ester having a kinematic viscosity at 100° C. ranging from 500 to 5000 $mm^2/s$ and a non-polarity index (NPI)

$$NPI = \frac{\text{total number of carbon atoms} * \text{molecul weight}}{\text{number of carboxylate groups} \times 100}$$

of at least 500 in an automotive engine oil.

According to a further embodiment of the present invention a method of reducing wear in an automotive engine by the addition of an automotive engine oil comprising a base oil and an ester which is the reaction product of (a) at least one polyfunctional alcohol;

(b) a dimer fatty acid; and (c) optionally at least one of an aliphatic dicarboxylic acid having 5 to 18 carbon atoms, an aliphatic monocarboxylic acid having 5 to 24 carbon atoms and an aliphatic monofunctional alcohol having 5 to 24 carbon atoms with the resultant ester having a kinematic viscosity at 100° C. ranging from 500 to 5000 $mm^2/s$ and a non-polarity index (NPI)

$$NPI = \frac{\text{total number of carbon atoms} * \text{molecul weight}}{\text{number of carboxylate groups} \times 100}$$

of at least 500 wherein the automotive engine oil has a phosphorus level of no more than 0.08%.

According to a further embodiment of the present invention an automotive engine comprising an automotive engine oil comprising a base oil and an antiwear additive system comprising an ester which is the reaction product of (a) at least one polyfunctional alcohol;

(b) a dimer fatty acid; and (c) optionally at least one of an aliphatic dicarboxylic acid having 5 to 18 carbon atoms, an aliphatic monocarboxylic acid having 5 to 24 carbon atoms and an aliphatic monofunctional alcohol having 5 to 24 carbon atoms with the resultant ester having a kinematic viscosity at 100° C. ranging from 500 to 5000 $mm^2/s$ and a non-polarity index (NPI)

$$NPI = \frac{\text{total number of carbon atoms} * \text{molecul weight}}{\text{number of carboxylate groups} \times 100}$$

of at least 500.

The automotive engine comprising an automotive engine oil according to the invention exhibits a camshaft lobe wear, measured according to the Sequence IVA test, of not more than 90 μm, preferably not more than 70 μm, more preferably not more than 50 μm, particularly not more than 40 μm.

The automotive engine comprising an automotive engine oil according to the invention suffers wear resulting in a copper level in the automotive engine oil, measured at the end of the Sequence IVA test, of not more than 30 ppm by weight, preferably not more than 20 ppm, more preferably not more than 10 ppm and especially not more than 5 ppm.

The automotive engine comprising an automotive engine oil according to the invention suffers wear resulting in an iron level in the automotive engine oil, measured at the end of the Sequence IVA test, of not more than 90 ppm by weight, preferably not more than 70 ppm, more preferably not more than 50 ppm and especially not more than 20 ppm.

The invention will now be described further by way of example only with reference to the following Examples and Figures.

EXAMPLE 1

The Sequence IVA Engine Test method was undertaken for a formulated automotive engine oil having as base oil a mixture of Nexbase™ 3060 and Nexbase™ 3043, (colourless, catalytically hydroisomerised and dewaxed base oils comprising of hydrogenated, highly isoparaffinic hydrocarbons—Group III base oil) with the addition of 1% by weight of different antiwear additive systems. The results are detailed in Table 1.

TABLE 1

| Antiwear additive System | Ester/ZDDP solution A (50/50) | ZDDP solution B (comparative) | No additive (comparative) |
|---|---|---|---|
| Cam nose wear (μm) | 4 | 11.9 | 55.7 |
| Cam lobe wear (μm) | 24.1 | 56.4 | 393.2 |
| Viscosity unused oil (at 40° C. in $mm^2/s$) | 68 | 70.8 | 66.4 |
| Viscosity used oil (at 40° C. in $mm^2/s$) | 52.9 | 52.4 | 52.8 |
| Zn content (ppm) | 533 | >900 | 7 |
| Fe content (ppm) | 10 | 58 | 431 |
| Cu content (ppm) | 1 | 3 | 1 |

The ester is the reaction product of neopentylglycol (167 kg) with dimer acid with at least 95% dimer present (833 kg) and C9 dicarboxylic acid (12.5 kg). The ester has a viscosity at 100° C. of about 2000 $mm^2/s$ and an NPI of typically greater than 2500.

The ZDDP solution A is Lubrizol L1371.

The ZDDP solution B is Infineum C9417

The automotive engine oil with ZDDP as antiwear additive system contains 0.1% phosphorus. The automotive engine oil with the ester/ZDDP blend as the antiwear additive system contains 0.05% phosphorus.

The data in Table 1 clearly illustrates that an antiwear additive system according to the present invention has significantly reduced cam lobe and cam nose wear as compared to the commercially available ZDDP and has much lower phosphorus, sulphur and metal content. Also the minimal change in the viscosity of the oil at 40° C. is indicative of the oxidative stability of the automotive engine oil.

EXAMPLE 2

Figure 1:
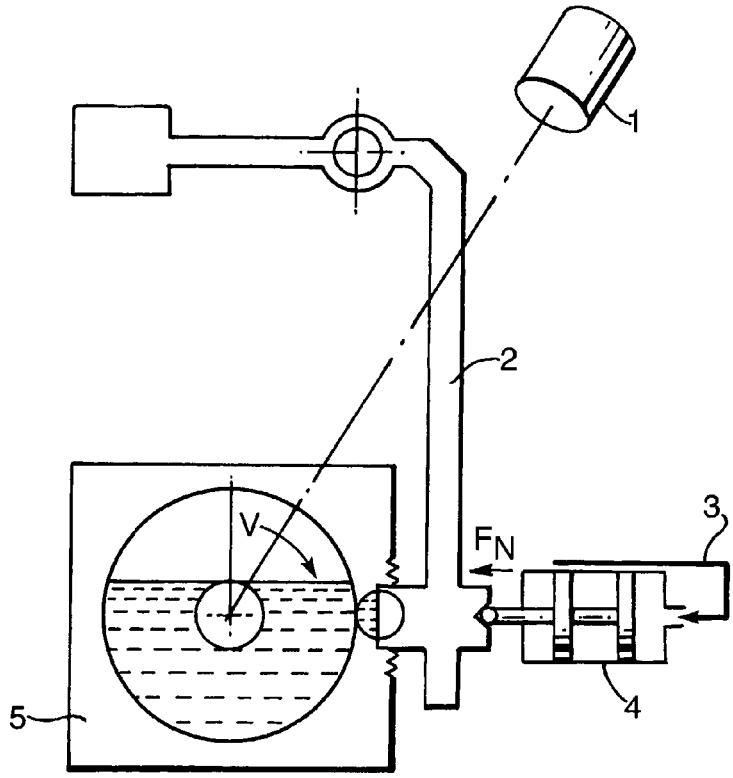
FIG. 1 illustrates the ball-on-ring tribometer used for Example 2.

The critical load ($F_N$ measured in N) (ie the load above which a large increase in wear rate is observed) was determined for a base oil (SN150—solvent refined Gp I paraffinic base oil ex Esso) with a variety of anti-wear additives using a ball-on-ring tribometer as illustrated in FIG. 1 at a variety of contact velocities (v measured in m/s) between the stationary ball and the curved surface of the rotating ring. Both the ball and the ring are made of steel EN31 (ball-bearing steel). In FIG. 1 1 is a torque meter, 2 is a lever, 3 is flow of pressurised air, 4 is a load unit and 5 the base oil and anti-wear additives.

Figure 2:
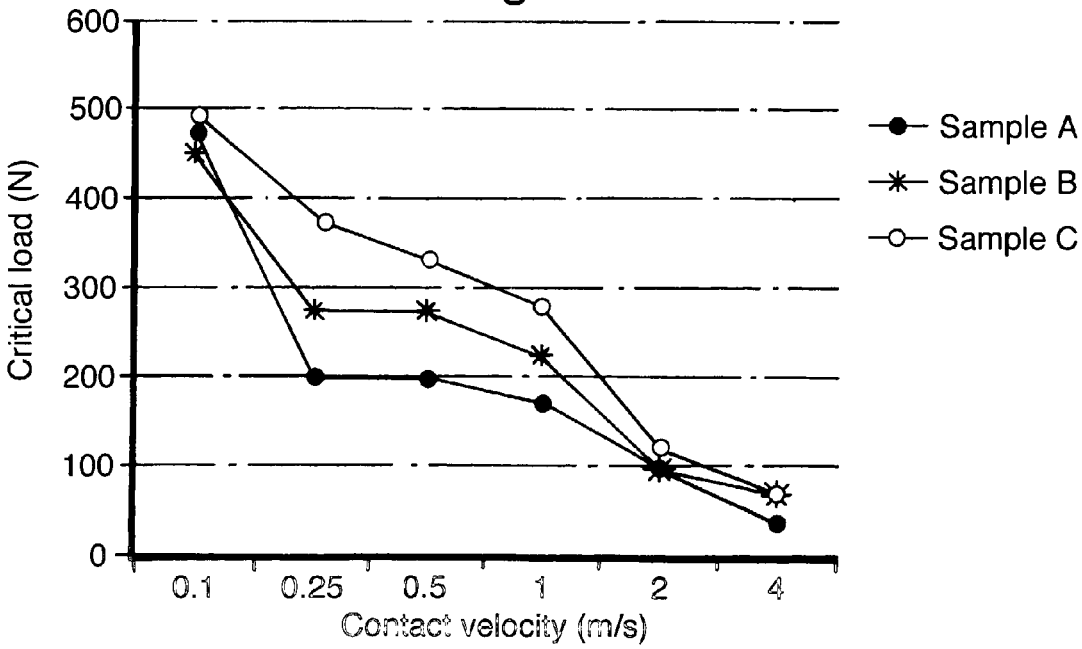
FIG. 2 illustrates the results from Table 2 for Example 2.

The results are illustrated in Table 2 and FIG. 2.

TABLE 2

| Anti-wear additive | Contact Velocity (v) | Critical force($F_N$) |
|---|---|---|
| Not Present - Sample A | 0.1 | 475 |
| | 0.25 | 200 |
| | 0.5 | 200 |
| | 1 | 175 |
| | 2 | 100 |
| | 4 | 40 |
| 1% sec- ZDDP - Sample B | 0.1 | 450 |
| | 0.25 | 275 |
| | 0.5 | 275 |
| | 1 | 225 |
| | 2 | 100 |
| | 4 | 75 |
| 0.5% sec-ZDDP and 0.5% Ester - Sample C | 0.1 | 500 |
| | 0.25 | 375 |
| | 0.5 | 350 |
| | 1 | 275 |
| | 2 | 125 |
| | 4 | 75 |

Ester is as defined in Example 1.

The automotive engine oil with ZDDP as antiwear additive system contains 0.1% phosphorous. The automotive engine oil with the ester/ZDDP blend as the antiwear additive system contains 0.05% phosphorus.

The data in Table 2 and FIG. 2 clearly shows that an anti-wear additive system according to the invention has a higher critical load than ZDDP itself. Therefore higher contact pressure can be tolerated without catastrophic wear.

The invention claimed is:

1. A method of reducing wear in an automotive engine by the addition to the engine an automotive engine oil comprising a base oil and an ester which is the reaction product of (a) at least one polyfunctional alcohol;

(b) a dimer fatty acid having a dimer content of greater than 94% by weight; and (c) at least one of an aliphatic dicarboxylic acid having 5 to 18 carbon atoms and an aliphatic monocarboxylic acid having 5 to 24 carbon atoms;

wherein the resultant ester has a kinematic viscosity at 100° C. ranging from 1500 to 5000 $mm^2/s$ and a non-polarity index (NPI)

$$NPI = \frac{\text{total number of carbon atoms} \times \text{molecular weight}}{\text{number of carboxylate groups} \times 100}$$

of at least 500; and wherein the automotive engine oil has a phosphorus level of no more than 0.08%.

2. The method of claim 1, wherein (c) is an aliphatic dicarboxylic acid having 5 to 18 carbon atoms.

3. The method of claim 1, wherein the polyfunctional alcohol is a polyol of formula R(OH)n where n is an integer which ranges from 1 to 10 and R is a hydrocarbon chain of 2 to 15 carbon atoms where the polyol is of molecular weight in the range from 50 to 650.

4. The method of claim 1, wherein the resultant ester has a kinematic viscosity at 100° C. of 1500 to 3500 $mm^2/s$.

5. The method of claim 1, wherein the resultant ester has an NPI value of at least 900.

6. The method of claim 1, wherein the resultant ester has an average molecular weight of at least 3000.

7. The method of claim 1, wherein the engine oil further comprises a phosphorus-containing and/or sulphur-containing antiwear additive.

8. The method of claim 1, wherein the engine oil further comprises both a phosphorus-containing and sulphur-containing additive.

9. The method of claim 1, wherein the engine oil further comprises zinc dialkyl dithiophosphate.

10. The method of claim 1, wherein the at least one polyfunctional alcohol is neopentylglycol; and the component (c) is azelaic acid.

11. The method of claim 1, wherein the resultant ester has a kinematic viscosity at 100° C. of 1500 to 4000 $mm^2/s$.

12. The method of claim 1, wherein the resultant ester further comprises an aliphatic monofunctional alcohol having 5 to 24 carbon atoms.

13. A method of reducing wear in an automotive engine by the addition to the engine an automotive engine oil comprising a base oil and an ester which is the reaction product of:

(a) at least one polyfunctional alcohol;

(b) a dimer fatty acid; and (c) at least an aliphatic dicarboxylic acid having 5 to 18 carbon atoms;

wherein the resultant ester having a kinematic viscosity at 100° C. ranging from 1500 to 5000 $mm^2/s$ and a non-polarity index (NPI)

$$NPI = \frac{\text{total number of carbon atoms} \times \text{molecular weight}}{\text{number of carboxylate groups} \times 100}$$

of at least 500; and wherein the automotive engine oil has a phosphorus level of no more than 0.08%.

* * * * *